US008398375B2

(12) United States Patent
Tanaka et al.

(10) Patent No.: US 8,398,375 B2
(45) Date of Patent: Mar. 19, 2013

(54) IMPELLER

(75) Inventors: Kohei Tanaka, Hitachinaka (JP); Yoshimasa Chiba, Tsukuba (JP); Sadashi Tanaka, Kasumigaura (JP); Koji Hayashi, Kasumigaura (JP); Tomohiro Naruse, Hitachinaka (JP); Takaki Fukuchi, Kasama (JP); Takeshi Kazama, Kasumigaura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 661 days.

(21) Appl. No.: 12/388,063

(22) Filed: Feb. 18, 2009

(65) Prior Publication Data

US 2009/0246030 A1 Oct. 1, 2009

(30) Foreign Application Priority Data

Mar. 26, 2008 (JP) ..... 2008-080320

(51) Int. Cl.
*B64C 11/04* (2006.01)
*F03B 3/12* (2006.01)
*F04D 29/34* (2006.01)

(52) U.S. Cl. ..... 416/219 R; 416/188; 415/115; 415/117

(58) Field of Classification Search ..... 416/204 R, 416/213 R, 213 A, 182, 185, 188; 29/889, 29/889.2, 889.4; 415/115, 117
See application file for complete search history.

(56) References Cited

U.S. PATENT DOCUMENTS

| | | | | |
|---|---|---|---|---|
| 4,363,601 | A * | 12/1982 | Leskinen | 416/188 |
| 4,395,851 | A * | 8/1983 | Watts | 451/97 |
| 4,720,242 | A | 1/1988 | Lovisetto | |
| 6,203,415 | B1 * | 3/2001 | Torrance-Castanza et al. | 451/359 |
| 2009/0246030 | A1 | 10/2009 | Tanaka et al. | |

FOREIGN PATENT DOCUMENTS

| | | | |
|---|---|---|---|
| CN | 1032063 | A | 3/1983 |
| CN | 86103305 | A | 12/1986 |
| CN | 2546673 | Y | 4/2003 |
| CN | 101545499 | B | 7/2011 |
| JP | 58-127197 | U | 8/1983 |
| JP | 60-183292 | U | 12/1985 |
| JP | 10-047297 | | 2/1998 |
| JP | 4561852 | A | 8/2010 |
| WO | 95/19503 | A1 | 7/1995 |
| WO | 95/20724 | A1 | 8/1995 |

* cited by examiner

*Primary Examiner* — David Nhu
(74) *Attorney, Agent, or Firm* — Mattingly & Malur, PC

(57) ABSTRACT

To provide a can manufacturing pump impeller in which a stress of a base portion of a blade is prevented from increasing while improving the strength of a joint portion of a hub and a boss. In order to reinforce a joint portion of a hub and a boss, a plate is jointed to the inside of an impeller. In order not to overlap a base portion of a blade and the plate with each other on the hub, an opening portion is provided in the plate around the base portion of the blade on the hub. As a shape of the opening portion, a semicircular shape, a semielliptical shape, a rectangular shape, or a trapezoidal shape can be selected. Further, as a plate shape, a flat plate structure, a shell structure, or a curved structure can be selected.

9 Claims, 6 Drawing Sheets

IMPELLER

RELATED APPLICATIONS

This application claims priorty to Japanese Application No. 2008-080320, filed Mar. 26, 2008.

BACKGROUND OF THE INVENTION

1. Field of the Invention

The present invention relates to an impeller among a pump impeller and the like.

2. Description of the Related Art

A pump impeller attached to a rotational shaft requires a structure that bears a torque applied to the rotational shaft and a fluid pressure applied to a blade. Further, in order to produce a curved shape to obtain a high fluid performance, a casting is generally used for the impeller. An example of a conventional pump impeller is described in Japanese Patent Application Laid-Open No. H10-47297. The pump impeller is shown in FIG. 6 of Japanese Patent Application Laid-Open No. H10-47297 in which a main body of the impeller is fitted into a rotational shaft through a key, and a rotational force of a motor is transmitted to a cylindrical boss from the rotational shaft through the key. Plural blades are attached to a cone-shaped hub, the rotational force transmitted to the impeller resists a fluid pressure applied to a blade surface, and a load is applied to a joint portion of the hub and the boss. Since the main body of the impeller is produced by using a casting, the joint portion of the hub and the boss of the impeller is locally thickened so as to produce a high-strength structure.

However, it is difficult to produce an inexpensive and light-weight impeller by using a casting. In order to realize light weight, it is conceivable that a light-weight material such as resin is used as a material, as described in Japanese Patent Application Laid-Open No. H10-47297, or the impeller is made small in thickness by using a metal material. Since a long product life is required for the impeller, a metal material such as stainless steel that is high in corrosion resistance is used, and an inexpensive metal material with the equal thickness is necessary as a material for the main structure.

If the impeller is made for can manufacturing, it is possible to realize a thin and light-weight structure, but the joint portion of the hub and the boss is extremely lowered in strength in the thin plate structure as compared to a casting structure. The light weight can not be realized in a thick structure, and the thin plate structure is therefore required while improving the strength of the joint portion of the hub and the boss.

A first object of the present invention is to provide a method of reinforcing a joint portion of a hub and a boss. In the meantime, by reinforcing the joint portion of the hub and the boss, a base portion of a blade is adversely lowered in strength in some cases. A second countermeasure of the present invention is to provide a structure to prevent the strength of the base of the blade from lowering.

BRIEF SUMMARY OF THE INVENTION

In order to achieve the above-described object, the present invention provides an impeller of a pump including: a cylindrical boss to which a rotational force of a motor is transmitted; a hub in a substantially cone shape; a joint portion of the hub and the boss; and plural blades attached on the hub, wherein a plate for reinforcement of the joint portion of the hub and the boss is arranged and attached to an inner surface of the hub and an outer surface of the boss by welding.

The main purpose of providing the plate is reinforcement of the boss, so that its arrangement position is located around the joint portion of the hub and the boss. Here, it is preferable that the plate is arranged nearer the joint portion of the hub and the boss relative to the position of a base portion of a leading edge of the blade on the hub, and the welded portion of the plate on the hub is not overlapped with the base portion of the blade on the hub. Further, in a structure in which the base portion of the blade on the hub is overlapped with the position of the plate, it is preferable that the welded portion of the plate and the hub is arranged at a position apart from the position where the maximum stress is generated in the entire base portion of the blade by a fluid pressure and a centrifugal force.

The plate to be arranged includes two kinds of shapes: one (hereinafter, referred to as a hermetic type) in which an opening portion is not provided and a fluid can not pass through; and the other one (hereinafter, referred to as an open type) in which an opening portion is provided and a fluid can pass through. They are selected in accordance with the shape, dimension, operation conditions, welding workability, and usage environments of the impeller. The hermetic type includes a circular disc shape and a shell shape with high-pressure resistance. Especially, the shell shape is employed in the case where a pressure difference between the inside and outside of the hub of the impeller is large.

In the open type, an opening portion such as a gap and a hole is provided in the plate. Especially, in order to prevent an increase in stress of the base portion of the blade caused by adding the plate, the plate is formed in a shape in which an opening portion in a semicircular shape or a semielliptical shape is provided around the base portion of the blade on the hub. For the same purpose, plural rectangular or circular arc plates are arranged so as not to be overlapped with the base portion of the blade on the hub. In these open-type structures, it is possible to prevent the base portion of the blade and the plate from overlapping with each other on the hub, to arrange the plate at a position apart from the joint portion of the hub and the boss, and to realize an arbitrary structure in consideration of welding workability.

In order to secure a flow channel inside and outside the impeller in which a circular balance hole for reducing a pressure difference between the inside and outside of the hub is provided in the hub, there are a hermetic-type plate in which an attachment position of the plate is located between the balance hole and the joint portion of the hub and the boss, and an open-type structure in which the balance hole is provided between the joint portion of the hub and the boss and the plate and an opening portion is provided in the plate. In the latter open-type structure, a flow channel passing through the balance hole can be secured even in the plate shape in which the opening portion in a semicircular shape or a semielliptical shape is provided. Further, a flow channel can be secured even in a structure in which the balance hole is jointed to the plate through a rectangular or cylindrical cover.

According to the present invention, it is possible to reinforce the joint portion of the hub and the boss to which a centrifugal force and a fluid pressure is applied in the impeller of the pump and to obtain a light-weight and high-strength impeller shape as compared to a conventional casting.

In a structure in which the base portion of the blade and the attachment position of the plate are overlapped with each other on the hub, a discontinuous structure causes an increase in stress of the base portion of the blade at some position. Especially, since a high pressure difference is generated in the hermetic-type plate, the stress is largely increased especially at the attachment position of the plate. However, in the open-type plate, the hub can be reinforced and an increase in stress of the base portion of the blade can be reduced with the shape in which the opening portion is provided in the base portion of the blade.

In general, corrosion is more likely to progress in a welded portion than in a base metal portion, and a countermeasure against corrosion such as a finishing or coating process for the welded portion is necessary. In the hermetic type, the welded portion inside the joint portion of the hub and the boss is not exposed to a fluid, so that the anticorrosion measurement is not necessary. Further, in the hermetic type, a high pressure is not directly applied to the inside of the joint portion of the hub and the boss, so that a low-strength condition can be selected with a finishing process for the inside of the joint portion of the hub and the boss.

DETAILED DESCRIPTION OF THE INVENTION

Hereinafter, embodiments of the present invention will be described in accordance with the drawings. As an example, an inclined flow pump will be described in the following drawings, but the present invention can be similarly applied to any can manufacturing rotary machines with blades. In addition, an example of a closed impeller will be shown in the following drawings, but the present invention can be similarly applied to an open impeller.

[First Embodiment]

Figure 1:
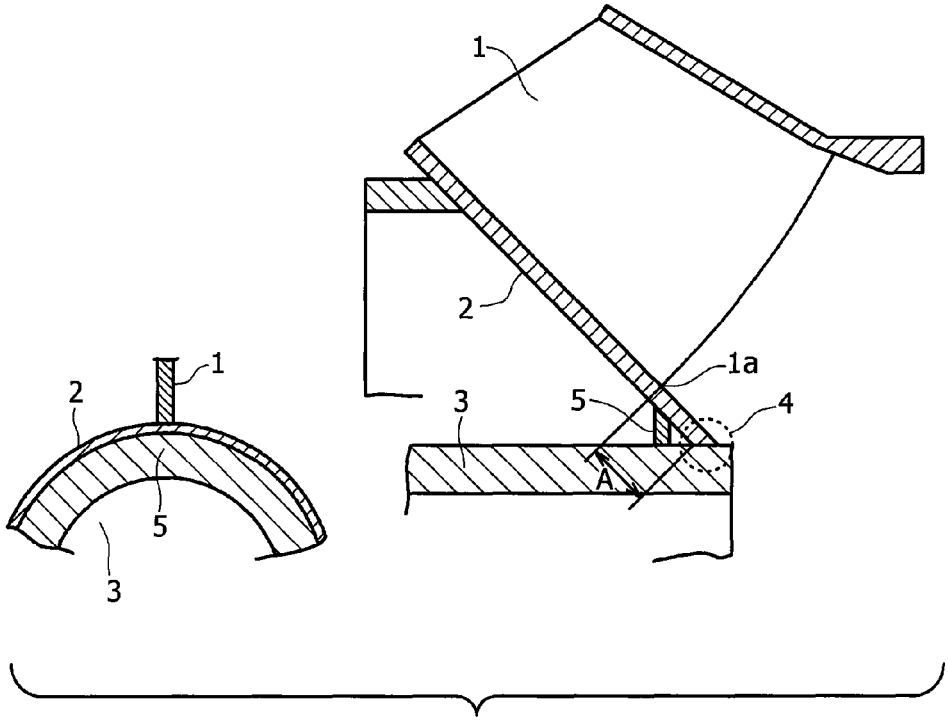
FIG. 1 shows a partial cross sectional view of a pump impeller and a front view of a plate according to a first embodiment of the present invention.

FIG. 1 shows a partial cross sectional view of an upper half from a dashed center line of an impeller and a front view of a plate 5. The impeller is configured in such a manner that plural blades 1 are attached to an outer surface of a cone-shaped hub 2 by welding. A portion where a cylindrical boss 3 fitted into a rotational shaft through a key (not shown) is attached to a hub 2 by welding serves as a joint portion 4 of the hub and the boss. Here, the blades 1, the hub 2, and the boss 3 are made of metal materials, and specifically, stainless is used. In the can manufacturing impeller, it is necessary to improve the strength of the joint portion 4 of the hub and the boss that bears a fluid pressure and a centrifugal force applied to the blade 1, and a pressure difference between the inside and outside of the impeller due to a smaller thickness of the joint portion 4 of the hub and the boss as compared to that made of a conventional casting, and a plate 5 is therefore arranged by welding for reinforcement.

The plate 5 is arranged nearer the joint portion 4 relative to the position of a base portion of a leading edge 1*a* of the blade 1 attached to the outer surface of the hub 2 within a range shown by A, and is configured in such a manner that a joint portion of the plate 5 and an inner surface of the hub, and a base portion of the blade on the outer surface of the hub are not overlapped with each other on the inner and outer surfaces of the hub 2. A fluid pressure applied to the base of the blade 1, a stress caused by a centrifugal force, and a stress applied to the joint portion of the plate 5 are not overlapped with each other, so that the stress is not partially concentrated at the hub 2.

Figure 2A:
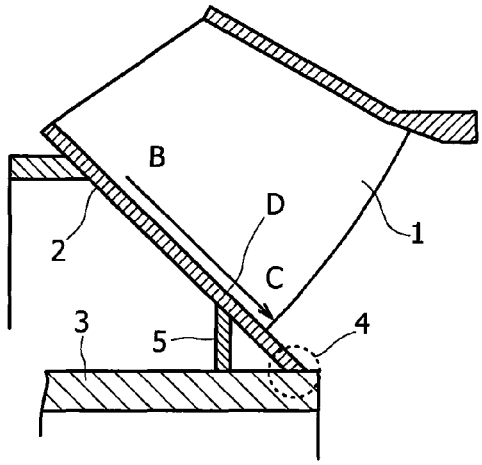
FIGS. 2A, 2B, and 2C show stress distribution views of a base portion of the pump impeller according to the first embodiment of the present invention.
Figure 2B:
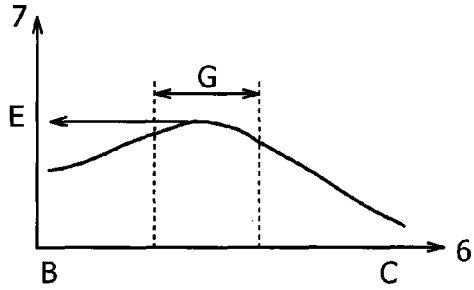
Figure 2C:
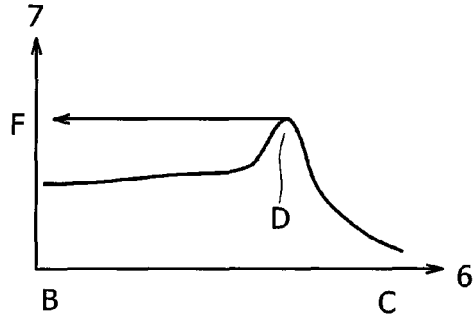

Here, a stress relative to an arrangement position of the plate 5 in the embodiment will be described. FIG. 2A is a cross sectional view of the impeller in the case where the position of the plate 5 and the base portion of the blade 1 are overlapped with each other. FIGS. 2B and 2C are pattern views each showing stress distribution at positions on the arrow B-C of the base of the blade shown in FIG. 2A. FIG. 2B is the stress distribution obtained before the plate 5 is added, and FIG. 2C is the stress distribution obtained after the plate 5 is added. In FIGS. 2B and 2C, the reference numeral 6 denotes a position on the hub 2 in the direction from B to C of the arrow, and 7 denotes a de degree of the stress. As shown in FIG. 2C, the stress at an attachment position D of the plate 5 is locally increased due to the discontinuous structure obtained by adding the plate 5. A maximum stress E before the plate is added and a maximum stress F after the plate is added satisfy the relation of E<F in many cases. In this case, the addition of the plate 5 reinforces the joint portion 4 of the hub and the boss. On the contrary, the stress of the base portion of the blade 1 is increased, which means a decrease in strength of the base portion of the blade. In the case where the design strength can be secured with the maximum stress F of the base portion of the blade, the plate 5 can be arranged at an arbitrary position in the impeller. However, the plate 5 is arranged, especially, at a position where the plate and the base portion of the blade (on the arrow B-C in FIG. 2A) are not overlapped with each other, namely, within the range shown by A in FIG. 1 in the embodiment. This countermeasure enables to suppress an increase in stress of the base portion of the blade.

In the case where the impeller is configured in such a manner that the base portion of the blade on the outer surface of the hub, and the attachment position D of the plate on the inner surface of the hub are overlapped with each other on the inner and outer surfaces of the hub 2 as shown in FIG. 2A, it is desirable that a position (a range shown by G) where the maximum stress is generated at the base portion of the blade by the fluid pressure and the centrifugal force, and the attachment position D of the plate 5 on the inner surface (back surface) of the hub 2 are not overlapped with each other on the inner and outer surfaces of the hub, so that the combined stress is not rapidly increased.

[Second Embodiment]

Figure 3:
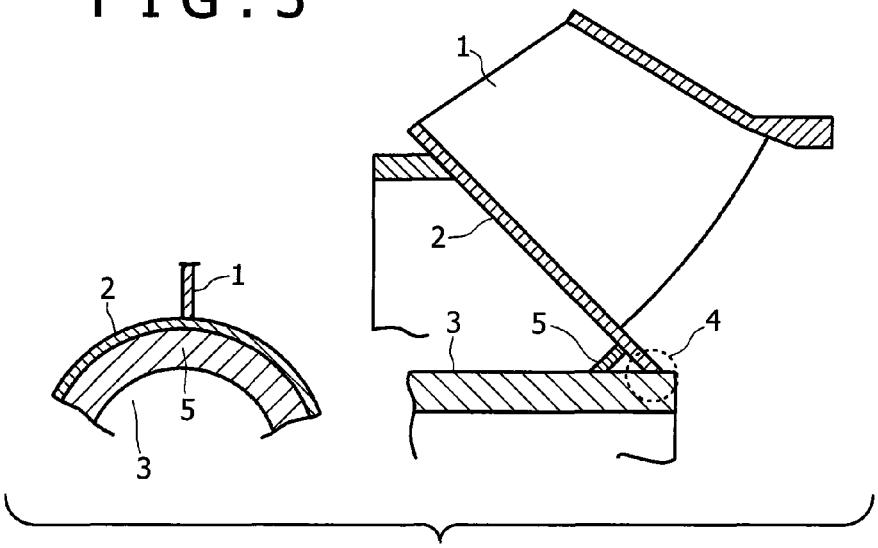
FIG. 3 shows a partial cross sectional view of a pump impeller and a front view of a plate according to a second embodiment of the present invention.

FIG. 3 shows a cross sectional view of the impeller and a front view of the plate 5. The plate 5 shown in each of FIGS. 1 and 2 is an example in which the plate 5 is attached to the cylindrical boss 3 by welding in a substantially vertical manner. A welding joint becomes high in strength if an angle formed by plates which are attached to each other by welding becomes almost a right angle, and welding workability is also improved. The embodiment of FIG. 3 is structured in such a manner that the plate 5 is obliquely attached the cylindrical boss 3 by welding and the plate 5 is attached to the hub 2 by welding in a substantially orthogonal manner, so that the welding strength of the plate 5 nearer the hub 2 is improved. According to this structure, it is possible to increase the strength of the plate 5 and the hub 2 that is smaller in thickness and lower in strength than the boss 3, and to obtain a light-weight and high-strength impeller shape.

[Third Embodiment]

Figure 4:
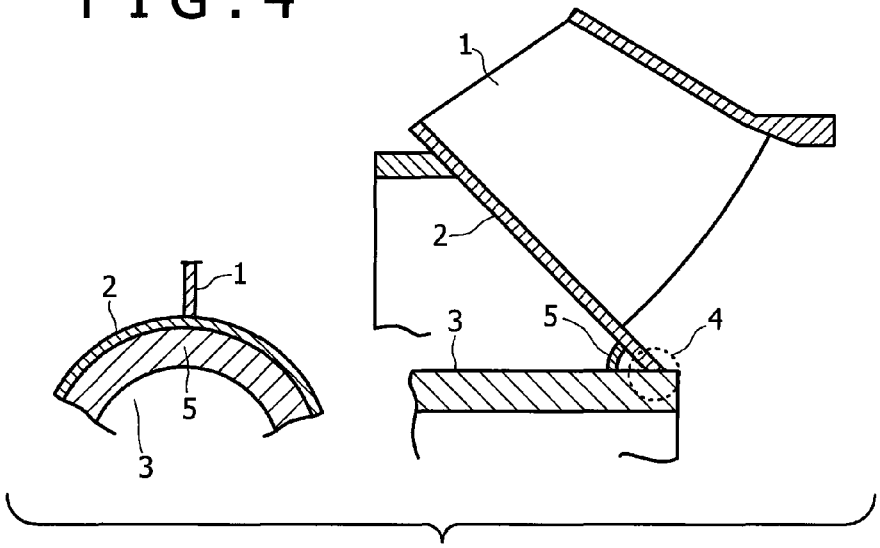
FIG. 4 shows a partial cross sectional view of a pump impeller and a front view of a plate according to a third embodiment of the present invention.

FIG. 4 shows a cross sectional view of the impeller and a front view of the plate 5. In the embodiment, as a countermeasure to improve the welding strength of the plate 5 on both sides of the hub 2 and the boss 3, the plate 5 is shaped in a manner that it is bent at the center of a circular arc in the radial direction so that the plate 5 is orthogonal to both of the hub 2 and the boss 3. It should be noted that since the plate 5 is in a rib-like shape in which it is bent at the center in the radial direction, the plate 5 is formed in a shell shape which is excellent in strength. Accordingly, the plate 5 which is smaller in thickness can be used when the same strength is required, which is useful in lightening the weight. Further, the plate 5 is attached to the hub 2 and the boss 3 by welding in a substantially vertical manner, so that the strength becomes higher.

[Fourth Embodiment]

Figure 5:
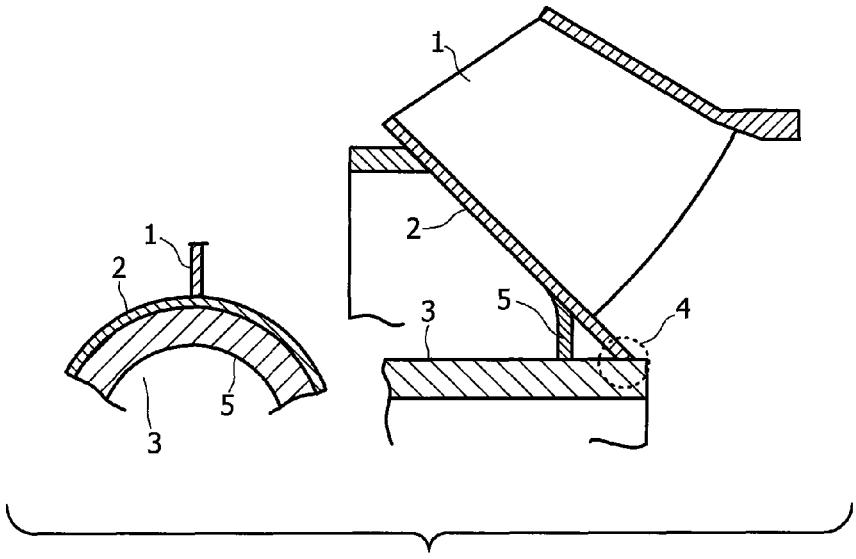
FIG. 5 shows a partial cross sectional view of a pump impeller and a front view of a plate according to a fourth embodiment of the present invention.

FIG. 5 shows a cross sectional view of the impeller and a front view of the plate 5. Since a high pressure is maintained outside the hub 2 by the rotation of the blades 1, the inside of the impeller (hub 2) largely differs in pressure from the outside thereof, and a high pressure is applied even to the hermetic plate 5 shown in each of FIGS. 1, 3, and 4. The embodiment is structured as a pressure-resistant structure to arrange the plate 5 in a shell shape which is more excellent in strength than a plate-like shape. The same effect as the third embodiment can be obtained.

[Fifth Embodiment]

Figure 6:
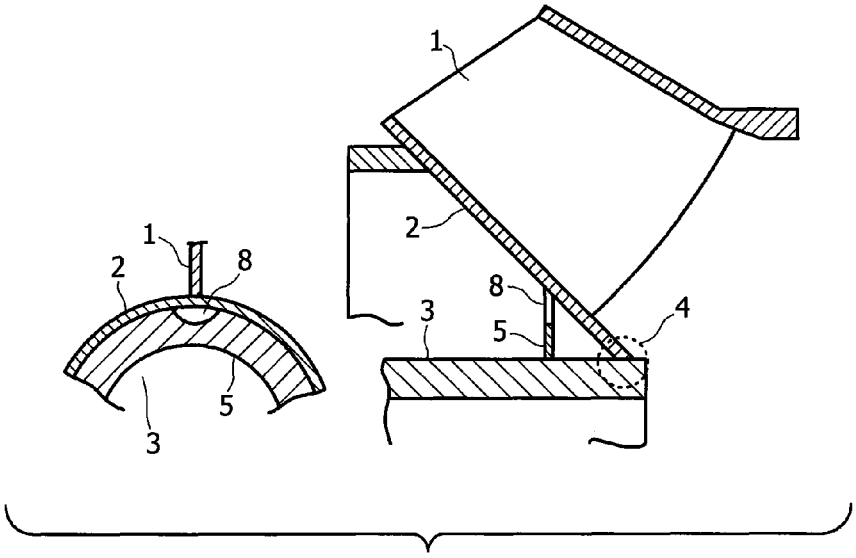
FIG. 6 shows a partial cross sectional view of a pump impeller and a front view of a plate according to a fifth embodiment of the present invention.

FIG. 6 shows a cross sectional view of the impeller with the plate 5 of the present invention and a front view of the positional relation between the blade 1 and the plate 5. In order to reinforce the joint portion 4 of the hub 2 and the boss 3, the plate 5 is arranged by welding in the impeller in the embodiment. However, in order not to overlap the base portion of the blade 1 on the hub side with the plate 5 on the hub 2, an opening portion 8 is partially provided in the plate 5 at a position where the base portion on the hub side intersects with the plate 5. By providing the opening portion 8, it is possible to reinforce the joint portion 4 of the hub 2 and the boss 3 as well as to suppress an increase in stress of the base portion of the blade. Further, the plate 5 can be arranged at an arbitrary position where the plate 5 intersects with and is overlapped with the base portion of the blade while being apart therefrom, so that the welding workability is improved if the plate 5 is arranged at a wider position apart from the narrow joint portion 4 of the hub 2 and the boss 3. As a shape of the opening portion 8, a semicircular shape, a semielliptical shape, a rectangular shape, or a trapezoidal shape can be selected.

[Sixth Embodiment]

Figure 7:
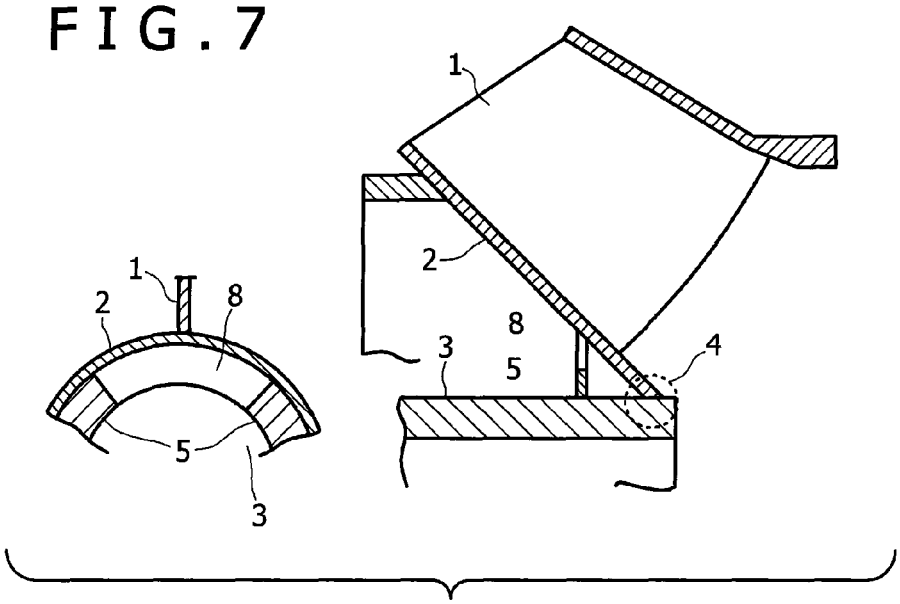
FIG. 7 shows a partial cross sectional view of a pump impeller and a front view of a plate according to a sixth embodiment of the present invention.

FIG. 7 shows a cross sectional view of the impeller and a front view of the plate 5. As similar to FIG. 6, in order not to overlap the base portion of the blade 1 on the hub side with the plate 5 on the hub 2, the opening portion 8 is provided. Although the opening portions 8 as many as the blades are provided in one plate in FIG. 6, the opening portion 8 is formed and arranged by shifting plural plates 5 which are divided in the circumferential direction from each other so as not to be overlapped with the base portion of the blade in the embodiment.

[Seventh Embodiment]

Figure 8:
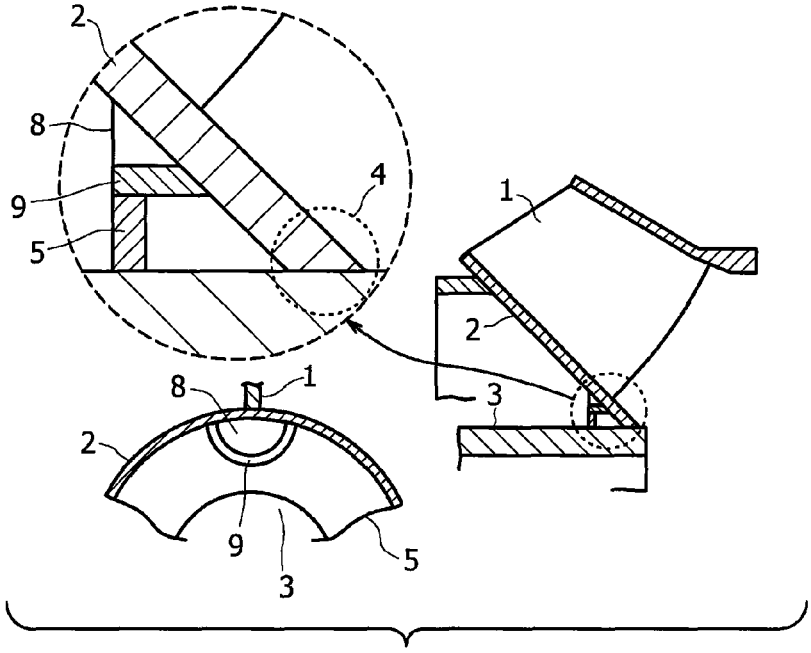
FIG. 8 shows a cross sectional view of an impeller, a front view of a plate, and an enlarged view of a joint portion of a hub and a boss according to a seventh embodiment of the present invention.

FIG. 8 shows a cross sectional view of the impeller, a front view of the plate 5, and an enlarged view of the joint portion 4 of the hub and the boss. As similar to FIG. 6, the opening portion 8 is provided in the plate 5, and a cylindrical cover 9 is arranged in the embodiment. The cylindrical cover 9 is jointed to the plate 5 and the hub 2, and is structured in such a manner that the base portion of the blade and the plate 5 are not overlapped with each other on the hub. In FIGS. 6 and 7, a fluid passing through the opening portion 8 applies a high pressure to the inside of the joint portion 4 of the hub and the boss, and a welded portion inside the joint portion 4 of the hub and the boss is exposed to the fluid. Accordingly, it is necessary to design in consideration of improvement in strength and a countermeasure against corrosion. However, the embodiment is advantageous in that a high pressure difference is not generated in the joint portion of the hub and the boss by providing the cylindrical cover 9, and it is not necessary to consider a countermeasure against corrosion in the boss.

[Eighth Embodiment]

Figure 9:
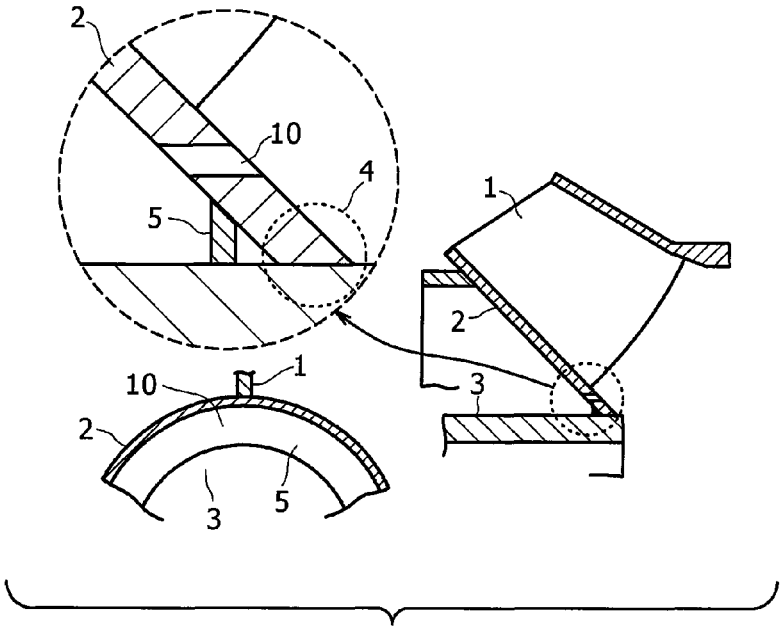
FIG. 9 shows a cross sectional view of an impeller, a front view of a plate, and an enlarged view of a joint portion of a hub and a boss according to an eighth embodiment of the present invention.

FIG. 9 shows a cross sectional view of the impeller, a front view of the plate 5, and an enlarged view of the joint portion 4 of the hub and the boss. In the embodiment, a balance hole 10 is provided in the hub 2 to reduce a pressure difference between the inside and outside of the impeller (hub 2). In the structure of the impeller shown in each of FIGS. 1, 3, 4, 5, and 8 in which the hermetic-type plate 5 is added, a flow channel passing through the balance hole 10 can not be secured. In the embodiment, the plate 5 is arranged nearer the joint portion 4 of the hub and the boss relative to the position of the balance hole 10, so that it is advantageous in that it is not necessary to consider a countermeasure against corrosion in the boss due to its hermetic property in which the inside of the joint portion 4 of the hub 2 and the boss 3 is not brought into contact with the fluid, and the flow channel inside and outside the impeller can be secured.

[Ninth Embodiment]

Figure 10:
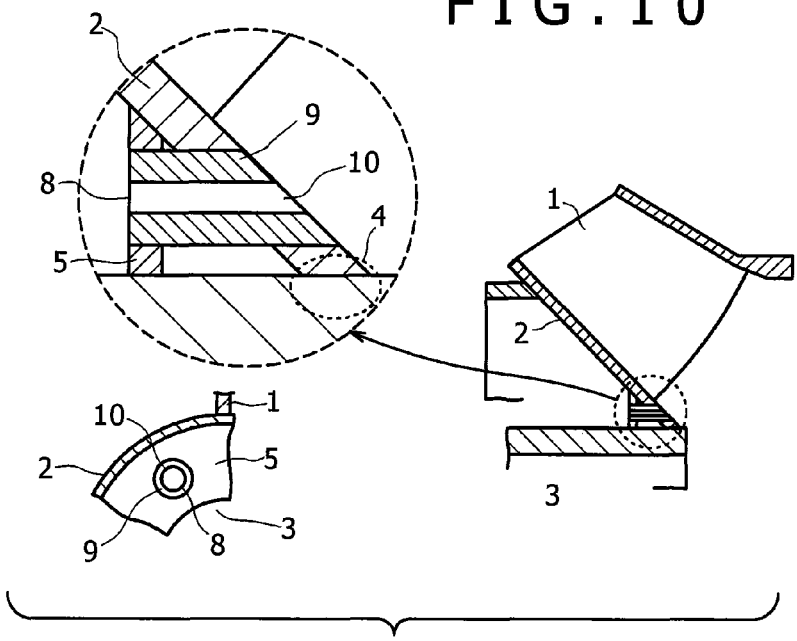
FIG. 10 shows a cross sectional view of an impeller, a front view of a plate, and an enlarged view of a joint portion of a hub and a boss according to a ninth embodiment of the present invention.

FIG. 10 shows a cross sectional view of the impeller, a front view of the plate 5, and an enlarged view of the joint portion 4 of the hub and the boss. The embodiment is structured in such a manner that the opening portion 8 is provided at a position inside the hub 2 so as to face the balance hole 10 outside the hub 2. Further, the embodiment is structured in such a manner that the opening portion 8 is directly coupled to the balance hole 10 through the cylindrical cover 9 in order to reduce turbulence of flow between the hub 2 and the plate 5. The cylindrical cover 9 is jointed to the plate 5 and the balance hole 10, so that a high pressure difference is not generated in the joint portion 4 of the hub and the boss, and it is not necessary to consider a countermeasure against corrosion in the joint portion 4 of the hub and the boss as similar to the hermetic plate 5.

What is claimed is:

1. An impeller of a pump comprising:

a cylindrical boss to which a rotational force of a motor is transmitted;

a hub in a substantially cone shape;

a joint portion of the hub and an end face or an outer surface of the cylindrical boss joined by welding; and a plurality of blades attached to the outer surface of the hub by welding, wherein a plate for reinforcement is arranged at the joint portion of the hub and the cylindrical boss while being welded to an inner surface of the hub and the outer surface of the cylindrical boss, wherein the plate is welded nearer to the joint portion of the hub and the cylindrical boss relative to a position of a base portion of a leading edge of the blade attached to the outer surface of the hub, and the welded position of the plate and the inner surface of the hub and the base portion of the blade on the outer surface of the hub are not overlapped with each other on the inner and outer surfaces of the hub.

2. The impeller according to claim 1, wherein the plate has a curved structure so as to be orthogonal to at least one of the inner surface of the cone-shaped hub and the outer surface of the cylindrical boss.

3. The impeller according to claim 1, wherein the plate has a curved structure in which the cross section of the plate is in a shell shape.

4. The impeller according to claim 1, wherein a balance hole that is a circular hole is provided in the hub, the plate is arranged nearer the joint portion of the hub and the cylindrical boss relative to the balance hole, and the inside of the joint portion of the hub and the cylindrical boss is not brought into contact with a fluid.

5. An impeller of a pump comprising:

a cylindrical boss to which a rotational force of a motor is transmitted;

a hub in a substantially cone shape;

a joint portion joining the hub and an end face or an outer surface of the cylindrical boss by welding; and a plurality of blades attached to the outer surface of the hub by welding, wherein a plate for reinforcement is arranged at the joint portion of the hub and the cylindrical boss while being welded to an inner surface of the hub and the outer surface of the cylindrical boss, wherein in the case where the welded position of the plate and the inner surface of the hub and a base portion of the blade on the outer surface of the hub are overlapped with each other on the inner and outer surfaces of the hub, a position where a maximum stress is generated in the base portion of the blade by a fluid pressure and a centrifugal force and the joint position of the plate and the inner surface of the hub are not overlapped with each other on the inner and outer surfaces of the hub.

6. The impeller according to claim 5, wherein a balance hole that is a circular hole is provided in the hub, the plate is arranged nearer the joint portion of the hub and the cylindrical boss relative to the balance hole, and the inside of the joint portion of the hub and the cylindrical boss is not brought into contact with a fluid.

7. An impeller of a pump comprising:

a cylindrical boss to which a rotational force of a motor is transmitted;

a hub in a substantially cone shape;

a joint portion joining the hub and an end face or an outer surface of the cylindrical boss by welding; and a plurality of blades attached to the outer surface of the hub by welding, wherein a plate for reinforcement is arranged at the joint portion of the hub and the cylindrical boss while being welded to an inner surface of the hub and the outer surface of the cylindrical boss, wherein by providing an opening portion in a semicircular shape, a semielliptical shape, a rectangular shape, or a trapezoidal shape at the plate on the hub side, a base portion of the blade on the outer surface of the hub and the welded position of the plate on the inner surface of the hub are not overlapped with each other on the inner and outer surfaces of the hub.

8. The impeller according to claim 7, wherein the opening portion of the plate and the surface of the hub are jointed to each other through a rectangular or cylindrical cover, and the inside of the joint portion of the hub and the cylindrical boss is not brought into contact with a fluid.

9. The impeller according to claim 4, wherein an opening portion is provided in the plate, the balance hole on the hub and the opening portion on the plate are jointed to each other through a rectangular or cylindrical cover, and the inside of the joint portion of the hub and the cylindrical boss is not brought into contact with a fluid.

* * * * *